US006863238B1

(12) United States Patent
Kojo et al.

(10) Patent No.: US 6,863,238 B1
(45) Date of Patent: Mar. 8, 2005

(54) METHOD AND DEVICE IN REEL CHANGE

(76) Inventors: Teppo Kojo, Alhontie 10, Mäntsälä (FI), FIN-04600; Janne Veräjänkorva, Nuumäentie 7 A 3, Espoo (FI), FIN-02710

( * ) Notice: Subject to any disclaimer, the term of this patent is extended or adjusted under 35 U.S.C. 154(b) by 1 day.

(21) Appl. No.: 10/148,120

(22) PCT Filed: Nov. 23, 2000

(86) PCT No.: PCT/FI00/01016

§ 371 (c)(1),
(2), (4) Date: Oct. 29, 2002

(87) PCT Pub. No.: WO01/38213

PCT Pub. Date: May 31, 2001

(30) Foreign Application Priority Data

Nov. 25, 1999 (FI) ..... 19992513

(51) Int. Cl.[7] ..... B65H 19/29
(52) U.S. Cl. ..... 242/532.3; 242/580; 156/184
(58) Field of Search ..... 242/532.3, 542.3, 242/580; 156/184, 191

(56) References Cited

U.S. PATENT DOCUMENTS

| | | | | |
|---|---|---|---|---|
| 4,572,451 A | | 2/1986 | Ikeda et al. | |
| 4,775,110 A | | 10/1988 | Welp et al. | |
| 5,441,211 A | * | 8/1995 | Ueda et al. | 242/526.1 |
| 5,782,426 A | | 7/1998 | Kinnunen et al. | |
| 6,467,719 B1 | * | 10/2002 | Rodriguez | 242/521 |
| 6,474,589 B1 | * | 11/2002 | Enwald et al. | 242/527.2 |

FOREIGN PATENT DOCUMENTS

| | | |
|---|---|---|
| DE | 41 16 963 | 11/1992 |
| DE | 44 15316 | 11/1995 |
| EP | 0 044 814 | 2/1984 |
| EP | 0 484 323 | 5/1992 |
| EP | 0 512 196 | 12/1994 |
| EP | 0 765 832 | 4/1997 |
| WO | WO 94/03386 | 2/1994 |
| WO | WO 98/17564 | 4/1998 |
| WO | WO 01/38213 | 5/2001 |

OTHER PUBLICATIONS

International Publication No. WO 01/38213 A3 with attached International Search Report for International Application No. PCT/FI00/01016 International Preliminary Examination Report for International Application No. PCT/FI00/01016.

* cited by examiner

*Primary Examiner*—Kathy Matecki
*Assistant Examiner*—Sang Kim
(74) *Attorney, Agent, or Firm*—Stiennon & Stiennon

(57) ABSTRACT

A paper web reeled on a reeling core is affected to form a reel at least by means of the torque of a reeling cylinder and the nip load, wherein in connection with the reel change a new reeling core is brought in nip contact with the reeling cylinder above the reeling cylinder, together with a change device especially a so-called gooseneck. During the reel change an adhesive or the like is applied between the layers of the paper web in connection with the cutting of the paper web by means of a cutting device. The adhesive or the like is applied on the surface of the reel that is being formed by means of a member applying the adhesive.

17 Claims, 2 Drawing Sheets

METHOD AND DEVICE IN REEL CHANGE

CROSS REFERENCES TO RELATED APPLICATIONS

This application is a US national stage application of PCT Application No. PCT/FI00/01016, filed Nov. 23, 2000, and claims priority on Finnish Application No. 19992513, filed Nov. 25, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method in reel change, in which a paper web to be reeled on a reeling core is affected at least by the torque of the reeling cylinder and the nip load to form a reel, wherein in connection with the reel change, a new reeling core is brought in nip contact with the reeling cylinder above the reeling cylinder together with a change device, especially a so-called gooseneck, and wherein an adhesive, or the like, is applied between the paper web layers during the reel change in connection with the cutting of the paper web by means of a cutting device.

As for the state of the art, reference is made to publication FI-B 102826, which discloses a method in reeling up a paper or paper board web, in which the paper web is supported during the reeling by means of a belt traveling via a nip between the reeling cylinder and the reel shaft. In connection with the reel change, an adhesive is sprayed on the paper web passed to the reel at the same time the paper web is cut. In said publication the adhesive is spread on the web passed to the reel within a fixed distance from the cutting line. Such a method is advantageous as such especially in so-called high-speed reeling, in which the web speeds exceed 1600 m/min. In cases where the web travels at high speed, the method according to the publication FI-B 102826 can be applied without actual drawbacks especially for such paper grades, in which the absorption of the adhesive is insignificant.

Advantageously, but not solely, the present invention relates to a method to be applied in connection with a Pope-type reel-up. The Pope-type reel-up is the oldest of the reel-up types currently in use. The function of the Pope-type reel-up is based on one roll that is driven, i.e. a reeling cylinder, and a paper reel pressed against the same and formed around a reeling core. The paper reel that is being formed rotates by means of friction between the reeling cylinder and the paper.

A surface drive reel-up based on the Pope method is advantageous in the production of relatively small reels, when the paper is not sensitive to the linear load. The paper also has to be sufficiently compressible. As such, the Pope-type reel-up has a very simple structure and it functions in a reliable manner. By means of the Pope method, the reel change is typically conducted with a change device, especially with a so-called gooseneck. In the gooseneck change a small, crosswise cut is made to the paper web before the reeling cylinder by means of a cutting device. The cut functions as an initial tear when the paper web is lifted around a new reeling core by means of a blow nozzle at the end of the gooseneck. In the Pope-type reel-up the web speeds vary between approximately 300 and 1500 m/min.

However, a drawback occurring in the act of applying the Pope method is that the surface layers of the reel reeled on the reeling core tend to slacken. There have been no suggestion as to how to keep tight the layers of a full reel reeled on the reeling core. This may cause significant production losses, the scope of which is primarily determined on the basis of the running speed and the smoothness of the paper web.

In addition to the Pope method, reeling methods are also used in which a third control variable is used in addition to the surface drive, i.e. a centre-drive apparatus placed in connection with the reeling core, as well as possibly a device for finishing the surface of the reel. The method according to the invention is also suitable to be used in connection with these more developed methods.

The above-mentioned special properties, especially those of Pope method as well as the problems occurring in the act of applying the same, have led up to the present invention. The method disclosed in the publication FI-B 102826, in which an adhesive is sprayed on a web passed to the reel, contains several drawbacks especially in view of the general technology applied in the Pope-type reel-ups and the paper grades generally used in Pope-type reel-ups. Especially in view of the continuity of the reeling, it is important to prevent the access of adhesive on the surface of the reeling cylinder in all conditions. The access of the adhesive on the surface of the reeling cylinder almost without exception causes a production break, which can even be a long-lasting one.

SUMMARY OF THE INVENTION

To eliminate the above-presented problems and especially to improve the state of the art in the technology applied in connection with so-called Pope-type reel-ups, as well as to produce new, advantageous possibilities in relation to reel change in other reeling up methods, the method according to the invention is primarily characterized in that the adhesive, or the like, is applied on the surface of the reel that is being formed. By means of this arrangement it is in all conditions possible to substantially minimize the possibility that the adhesive applied on the paper would be released on the surface of the reeling cylinder, even though e.g. the driving speeds were low and the paper grade porous, as is characteristic to the Pope method in particular. If the adhesive is absorbed in the paper, the absorption is most likely directed towards the centre boss of the paper reel that is being formed, because the adhesive is applied on the surface of the reel that is being formed when it has already passed the reeling cylinder. On the other hand, in the nip point of the reel-up a "protective" paper web is placed on the adhesive applied on the surface of the paper reel that is being formed and the contact point of the adhesive with the reeling cylinder is linear and of a very short duration, due to the nature of the nip, wherein the transfer of the adhesive through the paper web through the "protective" paper web to the reeling cylinder is very unlikely because of the aforementioned act of applying the adhesive on the surface of the reeling cylinder before the nip contact in the travel direction of the paper web.

It is particularly advantageous that the member applying the adhesive is placed in connection with a change device, especially a so-called gooseneck. The adhesive is applied to the paper reel that is being formed in connection with the reel change, immediately before the cutting of the paper web, wherein the change device used in the threading of the paper web to the new reeling core is a so-called gooseneck.

The gooseneck is placed in the change station before the cutting of the paper web, wherein the member applying the adhesive can be advantageously placed at the same point of location. The moment of transferring the gooseneck to the change station does not have to be substantially changed.

The invention also relates to a device in reeling up: The device is primarily characterized in that the member applying the adhesive is arranged to apply the adhesive on the surface of the reel that is being formed.

BRIEF DESCRIPTION OF THE DRAWINGS

The invention will be described in more detail with reference to the appended drawings, in which.

DESCRIPTION OF THE PREFERRED EMBODIMENTS

Figure 1:
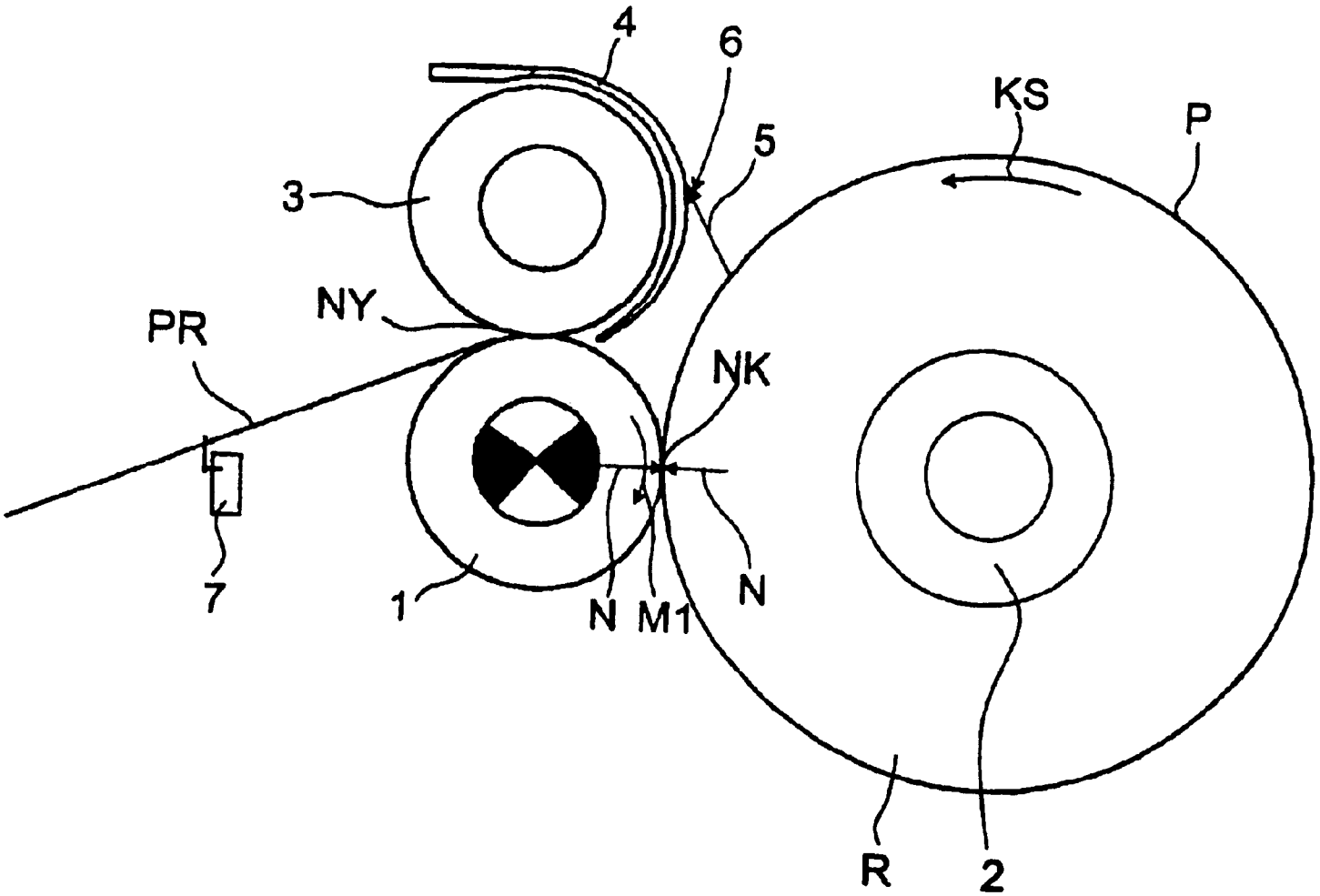
FIGS. 1 and 2 show a schematical side-view of two embodiments according to the invention.

FIG. 1 schematically shows a Pope-type reel-up comprising a reeling core 1 by means of which a paper web PR that is being reeled is affected to form a reel R. The function of the reeling cylinder 1 is, on one hand, based on torque M1 attained by means of the centre drive of the same, and on the other hand on a nip load N, which has a linear effect in the embodiment between the reeling cylinder and the reel R that is being formed. In connection with the change of the reel R, a new reeling core 3 is brought in nip contact NK with the reeling cylinder 1, above the reeling cylinder 1 together with a change device 4, i.e. a so-called gooseneck. In the situation of FIG. 1 the process has nearly proceeded to the reel change state.

During the change sequence of the reel R, an adhesive is applied between the paper layers (adhesive jet 5 in FIG. 1) in connection with the cutting of the paper web PR by means of a cutting device 7. In the embodiment of the invention according to FIG. 1, the adhesive (jet 5) is applied on the surface P of the reel R that is being formed, above the nip contact NK.

As can be seen in FIG. 1, the member 6 applying the adhesive (normally comprising three to four nozzles) is in this embodiment placed in connection with the gooseneck 4. The adhesive is applied on the surface of the reel R that is being formed immediately before the nip contact NK in the travel direction of the paper web PR (arrow KS). The adhesive is applied by means of a jet, wherein the adhesive jet which produces an adhesive stripe on the surface P of the reel R that is being formed, is in the presented embodiment produced diagonally downwards from above the nip contact NK.

The act of applying the adhesive is stopped before, but advantageously substantially at the same time the operation of the cutting device 7 is started. The cutting device 7 is placed before the reeling cylinder 1 in the travel direction of the paper web PR, within a distance from the member applying the adhesive. In the portioning of the adhesive it is possible to use one or more nozzles placed in connection with the change device 4, which nozzles can be positioned in such a manner that they produce a fan-like formation, wherein it is possible to supply several adhesive jets producing an adhesive stripe on the surface P of the reel R that is being formed, thus increasing the hold or attaining a stronger adherence by means of spraying the adhesive for a shorter period of time.

Most advantageously, the operating power of the pneumatically operated nozzles spraying the adhesive is attained from the gooseneck operating as a change device, in which pressurized air is already used. The adhesive can be conveyed via a pipework from a container located close to the Pope-type reel-up. To increase the pressure of the adhesive so that it is sufficient in view of applying the same, it is possible to place a pump close to the nozzles. The adhesive can be applied via the nozzles by starting the blowing from the gooseneck, wherein the pressurized air in use can be utilized as operating power of the nozzles. Each portioned adhesive stripe covers typically approximately ¼ of the length of the perimeter of the reel R. If a stronger hold is necessary, it is possible to increase the supply time of the adhesive thereby lengthening the adhesive stripe. The fact that the supply of the adhesive is stopped when the cutting device produces a cut, ensures that the adhesive remains underneath the surface layers of the paper web PR and does not enter in contact e.g. with the surface layers of the paper web PR, thereby not being able to touch the outer surface of the reeling cylinder.

Figure 2:
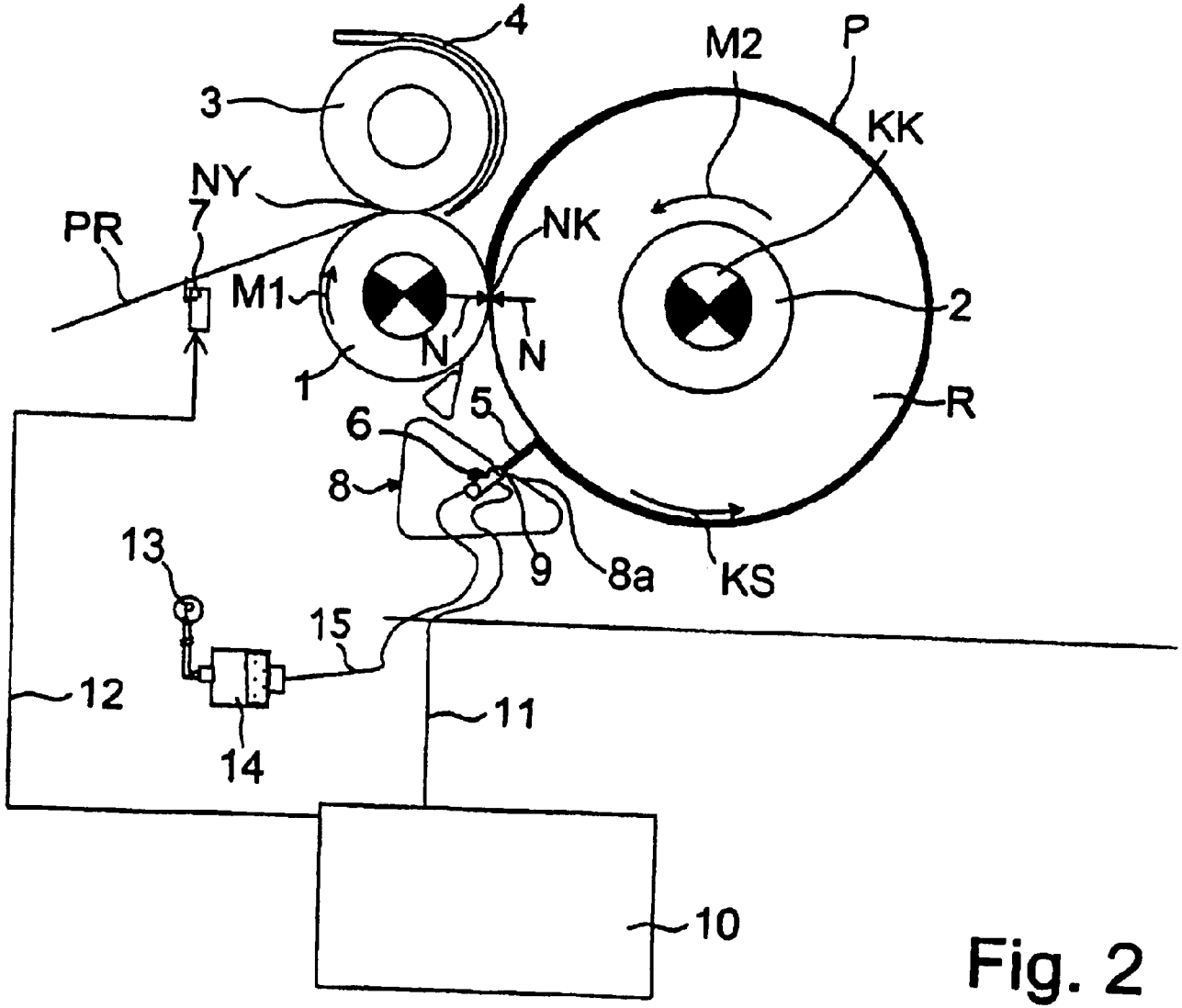

FIG. 2 shows an embodiment of the method according to the invention in a reel-up equipped with a centre-driven KK (torque M2) reeling core 2, said reel-up naturally also comprising the drives used in the reel-up according to FIG. 1. The parts corresponding to the embodiment of FIG. 1, are marked with corresponding reference numerals in FIG. 2. The structure according to FIG. 2 deviates from the structure of FIG. 1 in that respect that the member 6 applying the adhesive is placed inside a box-like pulper shield 8 with a triangular cross-section. In this embodiment, the member 6 applying the adhesive comprises three to four nozzles placed at fixed intervals substantially next to each other inside the pulper shield 8 whose length equals the length of the reeling cylinder. The pulper shield 8 is provided with a perforation 9 at the point of location of the nozzles, i.e. in the surface 8*a* of the triangular cross-section directed diagonally upward and towards the reeling cylinder 1, in the closed position of the pulper shield 8, via which the adhesive jets 5 are directed upwards, in the presented embodiment diagonally upwards on the surface P of the reel R after the nip contact in the travel direction of the paper web PR. Thus, the adhesive stripes (marked with a bold line in FIG. 2), substantially circle the outer perimeter of the reel R that is being formed.

FIG. 2 also presents a central processing unit 10 which is, for instance, utilized to control the act of applying the method according to the invention. The central processing unit 10 is connected (line 11 in FIG. 2) on one hand to the member 6 applying the adhesive and on the other hand to the cutting device 7 (line 12 in FIG. 2). The applying of the adhesive by means of the member 6 is stopped by means of a control command by the central processing unit 10 before, but advantageously substantially at the same time the operation of the cutting device 7 is started. The cutting device 7 is placed before the reeling cylinder 1 in the travel direction of the paper web PR, as in the embodiment of FIG. 1. The pressurized (pressure source 13) supply storage 14 of the adhesive is placed in transfer connection of the adhesive (line 15 in FIG. 2) with the member 6 applying the adhesive. The supply storage 14 can be a bag (cartridge-like) containing the adhesive, which is placed in the pressure space within the area of influence of the pressure of the pressure source 13, wherein the pressure compresses the bag thus producing a working pressure in the nozzles constituting the member 6 applying the adhesive, the operation of which nozzles is controlled by on/off principle by means of valves in connection with said nozzles. The bag constituting the supply storage 14 thus prevents the drying of the adhesive.

The agent effecting the operation according to the invention can also be called a binding agent, because adhesive properties, by means of which the layers of the paper web PR adhere to each other, are not necessarily required as such of said medium, but said medium has such an effect that it generates such changes in the surface of paper web layers positioned next to each other, that the layers adhere to each other. Thus, the binding agent binding the paper web layers together can be for example water. An advantageous adhesive, thanks to its pulpability, is starch dissolved or dispersed in water. In view of applying the method according to the invention, it is important that the adhesive forms as coherent a flow as possible, so that the drying would be as slight as possible, before the paper web layers are bound together, to attain the best possible adherence. This is especially important in the embodiment according to FIG. 2, in which adhesive stripe(s) or the like are exposed to drying for a considerably longer period of time as in the embodiment of FIG. 1. In this respect, a dripping adhesive jet is typically not advantageous, because a large free surface area is generated in the dripping jet, which accelerates the drying process.

What is claimed is:

1. A method in reel change, comprising the steps of:

passing a paper web in a travel direction towards a rotating reel;

reeling the paper web to form layers on a reeling core to form the rotating reel with a reeling cylinder having a torque, the reeling cylinder forming a nip with the rotating reel;

affecting the paper web on the reel being formed at least by means of the torque of the reeling cylinder and a nip load;

bringing a new reeling core in nip contact with the reeling cylinder;

applying an adhesive or a binding agent on a surface of the paper web which is wound on the rotating reel that is being formed, wherein said surface having first passed through the nip formed by the rotating reel and the reeling cylinder;

binding the paper web on the surface of the rotating reel by means of the adhesive or the binding agent by causing it to remain between the layers of the paper web on the rotating reel;

cutting the paper web running to the rotating reel being formed; and stopping the application of the adhesive or binding agent on the surface of the rotating reel before or substantially simultaneously with cutting the paper web.

2. The method of claim 1 wherein a change device is used in connection with the new reeling core for threading the paper web to the new reeling core.

3. The method of claim 2 wherein the adhesive or the binding agent is applied from a member placed in connection with the change device.

4. The method of claim 1 wherein the adhesive or the binding agent is placed on the surface of the paper web which is wound on the rotating reel that is being formed immediately before the web enters the nip contact between the rotating reel being formed and the reeling cylinder for a second time.

5. The method of claim 1 wherein the adhesive or the binding agent is applied on the surface of the rotating reel that is being formed immediately after said surface has first passed through the nip formed by the reel and the reeling cylinder.

6. The method of claim 1 wherein the adhesive or the binding agent is applied from a member placed in connection with a pulper shield.

7. The method of claim 1 wherein the cutting of the web is performed before the reeling cylinder in the travel direction of the paper web, within a selected distance from a member applying the adhesive or the binding agent.

8. A method in reel change, comprising the steps of:

passing a paper web in a travel direction towards a rotating reel;

reeling the paper web to form layers on a reeling core to form the rotating reel with a reeling cylinder having a torque, the reeling cylinder forming a nip with the rotating reel and the paper web passing through the nip before forming the layers on the reeling core;

affecting the paper web on the reel being formed at least by means of the torque of the reeling cylinder and a nip load applied at the nip between the reeling cylinder and the rotating reel;

bringing a new reeling core in nip contact with the reeling cylinder;

applying an adhesive or a binding agent on a surface of the paper web which is wound on the rotating reel that is being formed, wherein said surface having first passed through the nip formed by the reel and the reeling cylinder;

cutting the paper web running to the reel being formed;

binding a further portion of the paper web on to the surface of the paper web which is wound on the rotating reel by winding said further portion of the paper web on the adhesive or the binding agent applied on the surface of the paper web which is wound on the rotating reel, the further portion of the paper web forming a surface layer; and causing the adhesive or the binding agent to remain underneath the surface layer so that the adhesive or the binding agent is not able to touch the outer surface of the reeling cylinder.

9. A reeling device, comprising:

a reeling core, and a paper web extending around it to form a reel having a surface formed of said paper web;

a reeling cylinder arranged in nip contact with said reel, wherein the the web extends through the nip contact;

means for bringing a new reeling core in nip contact with said reeling cylinder;

a cutting device of the paper web; and a member arranged to apply an adhesive or a binding agent to a surface of the paper web after the surface of the web has passed through the nip contact during the rotation of the reel, and wherein the member is fixed to a change device used in threading of the paper web to the new reeling core wherein the member is arranged to apply the adhesive or the binding agent in a direction away from the new reeling core and toward the reel.

10. The device of claim 9, wherein the change device is a gooseneck.

11. The device of claim 9, wherein the member arranged to apply the adhesive or binding agent comprises one or more nozzles.

12. The device of claim 11, wherein said one or more nozzles are operated by means of pressurized air, and their operating power is arranged to be taken directly from the change device or from a separate pressure source.

13. The device of claim 12, wherein the change device is a gooseneck, and wherein the operating power is arranged to be taken directly from the gooseneck.

14. The device of claim 10 wherein the member arranged to apply the adhesive or the binding agent comprises several nozzles positioned in a fan-like formation in connection with the gooseneck.

15. A reeling device, comprising:

a reeling core arranged to receive a paper web around it to form a reel having a surface formed of said paper web;

a reeling cylinder arranged in nip contact with said reel so that the paper web passes through the nip and on to the reel to form said surface;

means for bringing a new reeling core in nip contact with said reeling cylinder;

a cutting device of the paper web; and a central processing unit connected to a member arranged to apply an adhesive or a binding agent and the central processing unit is connected to the cutting device of the paper web, the central processing unit arranged to give a stopping control command before or simultaneously with starting the operation of the cutting device to said member arranged to apply the adhesive or the binding agent, wherein the member is arranged to apply the adhesive or the binding agent to the paper web which has passed through the nip and forms the reel surface.

16. A reeling device, comprising:

a reeling core arranged to receive a paper web around it to form a reel having a surface formed of said paper web;

a driven reeling cylinder arranged in nip contact with said reel, the paper web passing over the reeling cylinder onto the reel at a first nip;

means for bringing a new reeling core in nip contact at a second nip with said reeling cylinder;

a cutting device of the paper web upstream of said first nip; and a member arranged to apply an adhesive or a binding agent to the surface of the paper web which forms the reel, at a position downstream of said first nip during rotation of the reel and fixed to a change device used in threading of the paper web to the new reeling core, wherein the member is arranged to apply the adhesive or the binding agent in a direction away from the new reeling core and toward the reel.

17. The device of claim 16 wherein the member arranged to apply the adhesive or the binding agent is positioned above the first nip.

* * * * *